US009212839B2

(12) United States Patent
McCoy

(10) Patent No.: US 9,212,839 B2
(45) Date of Patent: Dec. 15, 2015

(54) PORTABLE INSULATED ICE DISPENSER

(71) Applicant: Erliene Launetta McCoy, Manassas, VA (US)

(72) Inventor: Erliene Launetta McCoy, Manassas, VA (US)

( * ) Notice: Subject to any disclaimer, the term of this patent is extended or adjusted under 35 U.S.C. 154(b) by 0 days.

(21) Appl. No.: 13/767,802

(22) Filed: Feb. 14, 2013

(65) Prior Publication Data

US 2013/0214010 A1 Aug. 22, 2013

Related U.S. Application Data

(60) Provisional application No. 61/599,830, filed on Feb. 16, 2012.

(51) Int. Cl.
*B67D 7/80* (2010.01)
*F25C 5/00* (2006.01)
*A47G 19/32* (2006.01)

(52) U.S. Cl.
CPC ..... *F25C 5/007* (2013.01); *A47G 19/32* (2013.01)

(58) Field of Classification Search
CPC ..... B65D 81/38; G01F 11/10; B67D 7/06; F25D 3/02
USPC ..... 62/421–422, 424–425; 220/592.01, 220/592.11, 592.17–592.18, 592.23; 222/368, 189.06, 146.6, 185.1, 181.1
See application file for complete search history.

(56) References Cited

U.S. PATENT DOCUMENTS

| | | | | | |
|---|---|---|---|---|---|
| 227,290 | A * | 5/1880 | North | 62/422 |
| 291,857 | A * | 1/1884 | Welling | 222/131 |
| 342,330 | A * | 5/1886 | Colony | 62/424 |
| 1,535,927 | A * | 4/1925 | Look | 137/212 |
| 2,869,638 | A * | 1/1959 | Sullivan | 222/650 |
| 4,815,691 | A * | 3/1989 | Cooley | 249/120 |
| 4,995,238 | A * | 2/1991 | King | 62/125 |
| 5,048,171 | A * | 9/1991 | Bidwell et al. | 29/401.1 |
| 5,120,454 | A * | 6/1992 | Wieties | 210/767 |
| 5,842,606 | A * | 12/1998 | DeVito | 222/132 |
| 6,227,004 | B1 * | 5/2001 | Gerstein | 62/421 |
| 6,827,529 | B1 * | 12/2004 | Berge et al. | 406/28 |
| 6,964,355 | B2 * | 11/2005 | Landau | 222/185.1 |
| 7,703,639 | B2 * | 4/2010 | Landau et al. | 222/1 |
| 7,874,457 | B2 * | 1/2011 | Sowers et al. | 222/108 |
| 8,393,493 | B1 * | 3/2013 | Christensen | 220/592.18 |
| 2010/0276442 | A1 * | 11/2010 | Querfurth et al. | 222/1 |
| 2013/0233890 | A1 * | 9/2013 | Melzer | 222/189.06 |

* cited by examiner

*Primary Examiner* — Paul R Durand
*Assistant Examiner* — Andrew P Bainbridge
(74) *Attorney, Agent, or Firm* — Lyman H. Smith

(57) ABSTRACT

A portable, insulated ice dispenser stores ice in a closed container and dispenses it into a glass or cup without contact with the hands or utensils that could cause contamination. The ice dispenser can be manually operated to dispense ice. An ice storage compartment can include holes to drain water from the ice, slowing the melting of the ice and preventing the water from being dispensed. The ice dispenser is sanitary and simple in its design, making it low maintenance, inexpensive, and very appealing for home use as well as commercially. Since it is portable, the ice dispenser can be transported to anywhere its user would like to dispense ice and can be used outdoors at events, for example.

11 Claims, 4 Drawing Sheets

PORTABLE INSULATED ICE DISPENSER

CROSS-REFERENCE TO RELATED APPLICATION

This application claims the benefit of priority of U.S. provisional application No. 61/599,830, filed Feb. 16, 2012, the contents of which are herein incorporated by reference.

BACKGROUND OF THE INVENTION

The present invention relates to ice dispensers and, more particularly, to a portable, insulated ice dispenser.

Dinner hosts often have the dilemma of how to serve ice without contamination by many hands, whether those of the server(s) or those of the guests. This can pose a health risk. Another challenge is keeping the ice cubes from melting together before all are served.

Conventional systems for storing ice, such as ice buckets or bowls, are unsanitary, can result in ice melting and floating in water over time, and can be quite inconvenient, as ice tongs can be difficult to use and can be slow to get a quantity of ice, especially when the ice cubes are small in size, as ice tongs often only pick up one cube at a time. Therefore, guests oftentimes resort to dipping utensils, cups, or even their hands to get their ice.

More sophisticated systems may be available for commercial use, but such systems may be out of reach for most home uses due to their size, complexity, and impracticality. Additionally, their more complex design and dependency on external energy sources make them more high maintenance, more expensive, and less appealing for home use.

As can be seen, there is a need for an improved ice storing and dispensing system.

SUMMARY OF THE INVENTION

In one aspect of the present invention, an ice dispenser comprises a base; a base neck extending from the base; a support ring disposed on the base neck having a slot cut therein; an ice container fitting into the support ring, the ice container having a plurality of melt holes formed along its sides thereof; a knob extending out of the ice container, the knob fitting into the slot of the support ring, the plurality of melt holes disposed through the ice container from a region above the knob toward a top of the ice container; an insulated upper outer tray covering the ice container; and a plurality of turn fins turnable by the knob, the turn fins preventing ice cubes from falling out of the ice container, yet dispensing ice from the ice container when the knob is turned.

These and other features, aspects, and advantages of the present invention will become better understood with reference to the following drawings, description, and claims.

DETAILED DESCRIPTION OF THE INVENTION

Figure 1:
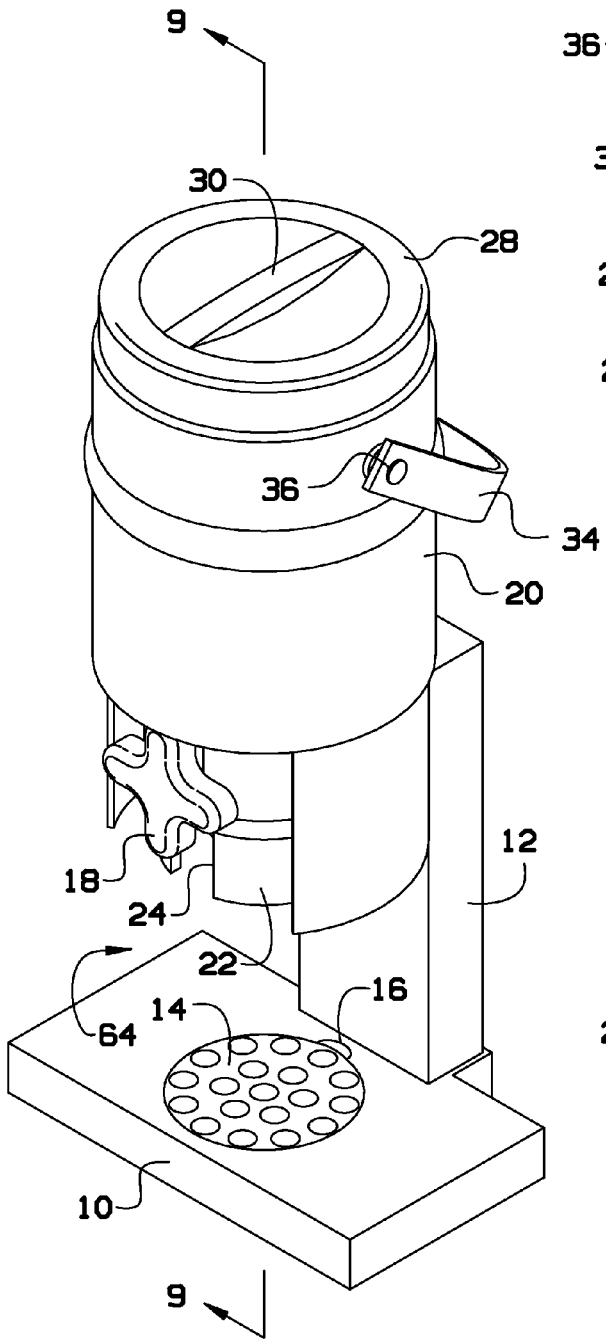
FIG. 1 is a perspective view of an ice dispenser according to an exemplary embodiment of the present invention.
Figure 2:
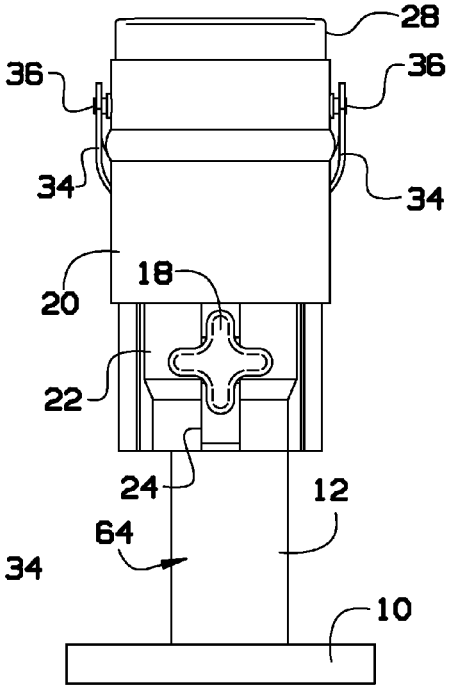
FIG. 2 is a front view of the ice dispenser of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable, insulated ice dispenser that stores ice in a closed container and dispenses it into a glass or cup without contact with the hands or utensils that could cause contamination. The ice dispenser can be manually operated to dispense ice. An ice storage compartment can include holes to drain water from the ice, slowing the melting of the ice and preventing the water from being dispensed. The ice dispenser is sanitary and simple in its design, making it low maintenance, inexpensive, and very appealing for home use as well as commercially. Since it is portable, the ice dispenser can be transported to anywhere its user would like to dispense ice and can be used outdoors at events, for example.

Referring to FIGS. 1 through 9, an ice dispenser includes a detachable base 10 having a base neck 12 extending form the base 10. The base neck 12 supports a base support ring 22 that supports an ice container 26. The base support ring 22 can include a base support ring slot 24 for allowing a knob 18, attached to the ice container 26, to extend therethrough.

A capture drip region 58 can be disposed in a base hole 50 in the base 10. A removable base drip cup 48 can fit into the base hole 50 to hold any water that may drip from the ice container 26. A plate 14, having holes formed therethrough, can be disposed over the removable base drip cup 48. A plate thumb notch 16 can be cut into the base 10 to allow a user easily to remove and insert the removable base drip cup 48.

The ice dispenser 26 can include an ice cube containment region 66 having a plurality of melt holes 44 disposed through sides thereof. The melt holes 44 can be formed around the sides of the ice dispenser 26, from the knob 18 toward the top of the ice dispenser 26. The ice dispenser 26 can have a cylindrical shape with a larger diameter upper portion and a smaller diameter lower portion. The larger diameter upper portion has the plurality of melt holes 44 disposed thereabout.

The ice dispenser 26 can rest in the base support ring 22. A removable seal 46 can seal the ice dispenser 26 in the base support ring 22. An ice container cap 28 can be disposed on the bottom of the ice dispenser 26 to cover a bottom side thereof.

An upper outer tray 20 can be disposed over the base support ring 22, surrounding the ice container 26. An upper outer tray handle 34 can be pivotably attached to the upper outer tray 20. In some embodiments, an upper outer tray handle pivot 36 can be provided to pivot the upper outer tray handle 34 on the upper outer tray 20. The upper outer tray 20 can include upper outer tray insulation 32. The insulation 32 can prolong the lifespan of ice cubes 52 stored in the ice container 26. An ice container cap 28 can fit over the ice container 26 and the upper outer tray 20. An ice container cap handle 30 can be disposed in the ice container cap 28 for ease of placement and removal thereof.

Figure 3:
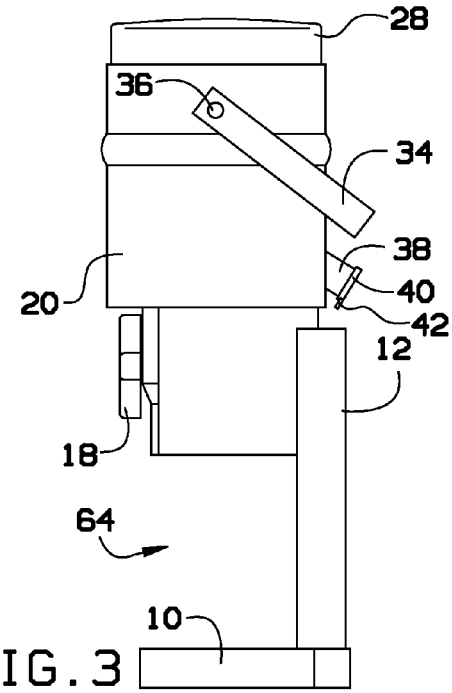
FIG. 3 is a side view of the ice dispenser of FIG. 1.
Figure 4:
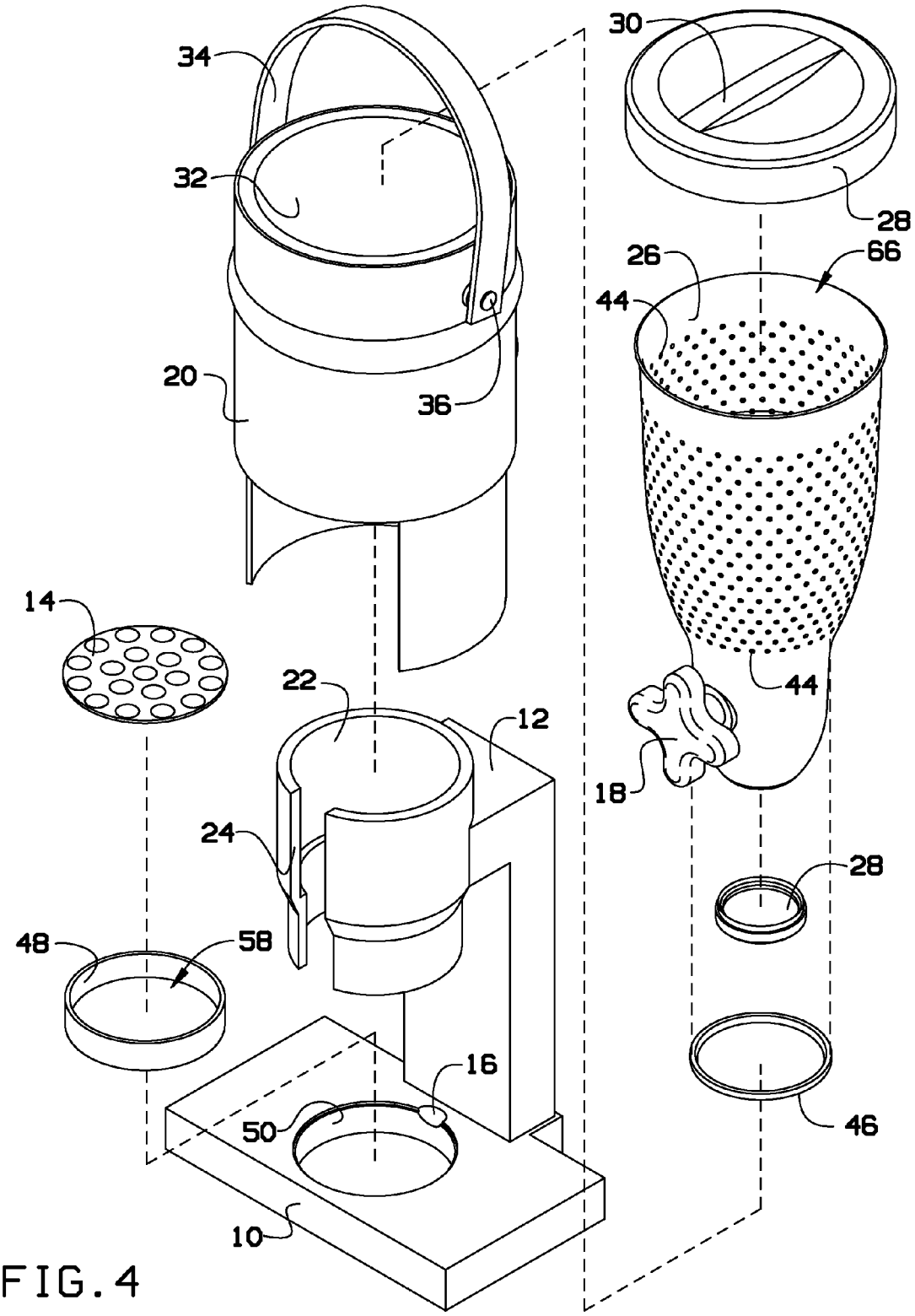
FIG. 4 is an exploded perspective view of the ice dispenser of FIG. 1, illustrated with an upper outer tray handle in a rotated configuration.
Figure 5:
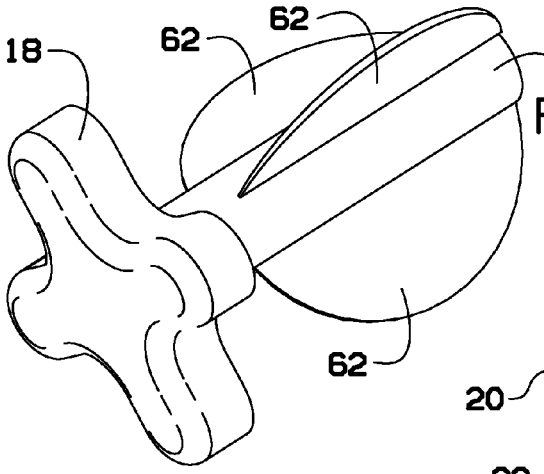
FIG. 5 is a perspective view of a knob used with the ice dispenser of FIG. 1.

As shown, for example, in FIG. 3, a capture container placement region 64 can be provided in front of the base neck 12. A cup, glass, or other container can be placed in the capture container placement region 64 to receive ice cubes 52 dispensed from the ice container 26.

A melt spout 38 can be provided on the back of the ice dispenser. The melt spout 38 can take water from melted ice 54 that passes through the melt holes 44 of the ice container 26 and deliver that water out of the ice dispenser. An ice container melt hole cap 40 can be attached to the melt spout 38 to prevent water from leaking out of the melt spout 38 when not desired. The ice container melt hole cap 40 can include a melt spout cap thumb plate for ease of opening and closing of the ice container melt hole cap 40. When using the ice dispenser, the user can close the melt spout 38, then eventually move the ice dispenser to a sink or other drain, lift the ice container melt hole cap 40, and drain water 54 from the ice dispenser. In some embodiments, a user can attach a tubing (not shown) to the melt spout 38 to allow water to drain continuously from the ice dispenser.

Figure 6:
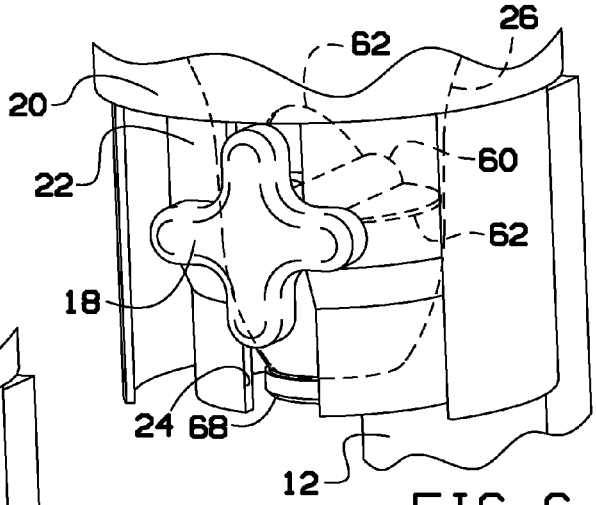
FIG. 6 is a detailed perspective view of the knob of the ice dispenser of FIG. 1.
Figure 7:
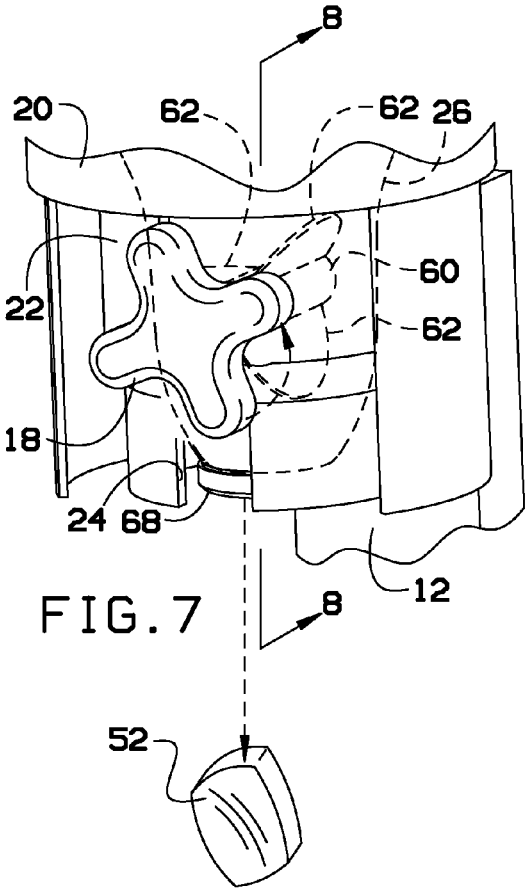
FIG. 7 is a detailed perspective view of the knob of the ice dispenser of FIG. 1, illustrating how turning the knob can result in an ice cube being dispensed from the dispenser.
Figure 8:
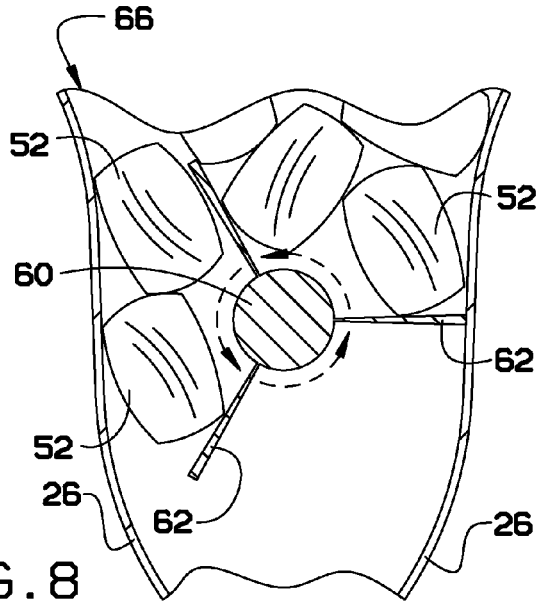
FIG. 8 is a cross-sectional view taken along line 8-8 of FIG. 7, illustrating turning of fins as the knob is turned to dispense ice.

The knob 18 can include a turn shaft 60 attached thereto. A plurality of turn shaft fins 62 can extend from the turn shaft 60. The turn shaft fins 62 can be sized to prevent ice cubes from falling out of the ice container 26 unless the knob 18 is turned. As shown in FIGS. 6 through 8, when the knob 18 is turned, the turn shaft 60 turns the turn shaft fins 62, allowing an ice cube 52 in the ice cube containment region 64 to be dispensed from an ice container ice cube exit hole 68 of the ice cube container 26. A capture container 56 can be disposed in the capture container placement region 64 (shown in FIG. 9) to catch the ice cubes 52. The turn shaft fins 62 can be flexible enough to allow a user to turn the knob 18 without the ice cubes 52 jamming from the motion thereof, but rigid enough to support the ice cubes and keep them in the ice container 26 and prevent unintentional dispensing thereof.

Figure 9:
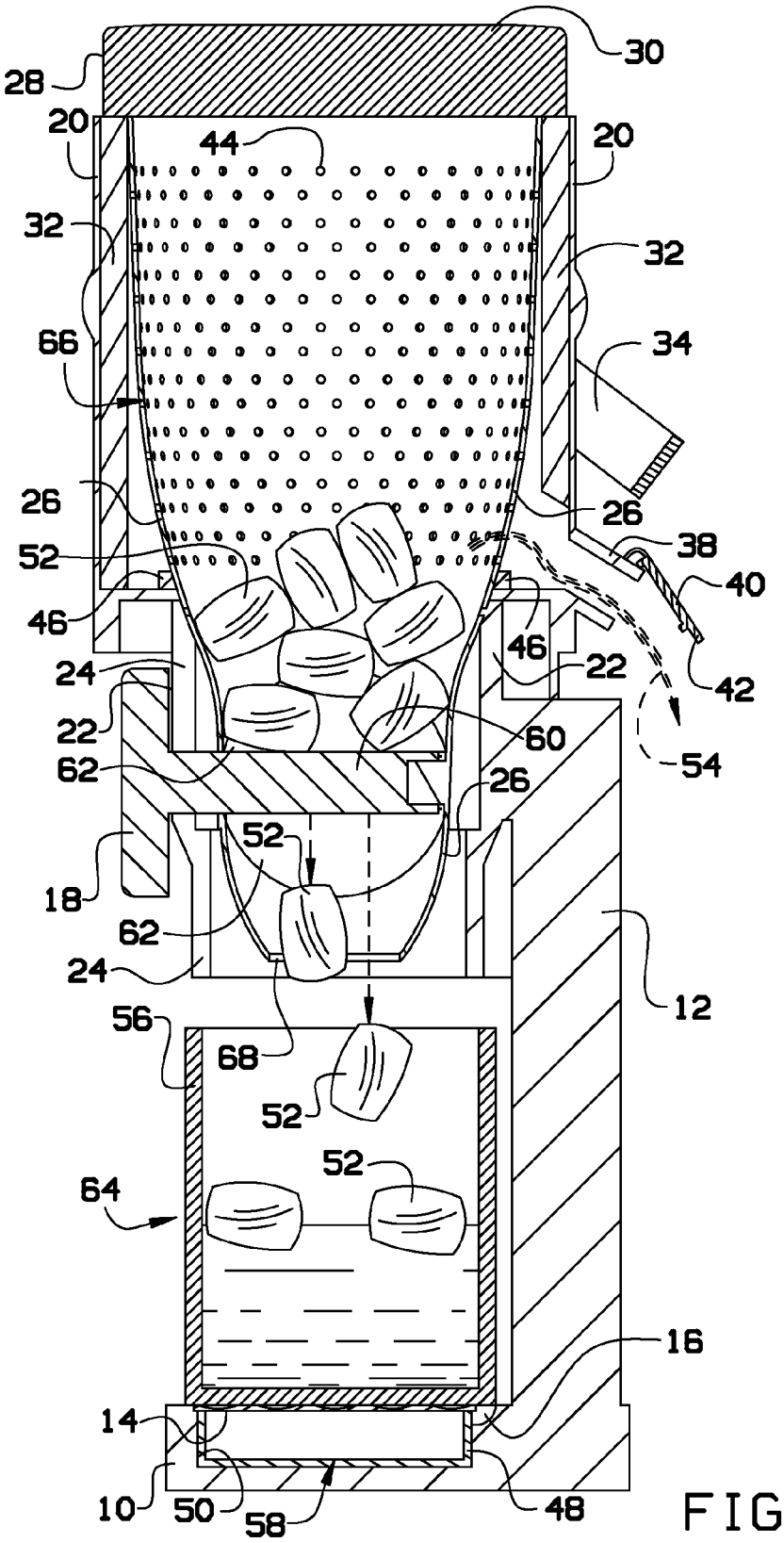
FIG. 9 is a cross-sectional view taken along line 9-9 of FIG. 1.

In use, as shown in FIG. 9, for example, a user can place ice cubes into the ice container 26. This can be done directly from, for example, a bag of ice cubes without the need to handle them, by removing the ice container cap 28. Should the ice melt before the need for a new bag of ice, the melting water can pass through melt holes 44 and drain initially into the interior area of the insulated upper outer tray 32, then eventually be drained out the melt spout 38. The seal 46 prevents the drained water from leaking onto the base support ring 22 and the base 10.

It should be understood, of course, that the foregoing relates to exemplary embodiments of the invention and that modifications may be made without departing from the spirit and scope of the invention as set forth in the following claims.

What is claimed is:

1. An ice dispenser comprising:

a base;

a base neck extending from the base;

a support ring disposed on the base neck having a slot cut therein;

an ice container fitting into the support ring, the ice container having a plurality of melt holes formed along sides thereof, the ice container having an upper region disposed above the support ring and a lower region encased by the support ring when the ice container is fit into the support ring;

a knob extending out of the ice container, the knob fitting into the slot of the support ring, the plurality of melt holes disposed through the ice container from a region above the knob toward a top of the ice container;

an insulated upper outer tray covering the ice container;

a plurality of turn fins turnable by the knob, the turn fins preventing ice cubes from falling out of the ice container, yet dispensing ice from the ice container when the knob is turned; and a melt spout formed as an opening in the upper outer tray, the melt spout permitting drainage of water from melting ice cubes in the ice container, wherein the plurality of melt holes are disposed in the upper region of the ice container and are absent from the lower region of the ice container, and the upper region of the ice container having a diameter larger than a diameter of the lower region of the ice container.

2. The ice dispenser of claim 1, further comprising a base hole in the base and a base drip cup fitting in the base hole.

3. The ice dispenser of claim 2, further comprising a thumb notch cut in the base along an upper edge of the base hole.

4. The ice dispenser of claim 2, further comprising a plate disposed over the base drip cup.

5. The ice dispenser of claim 1, further comprising an upper outer tray handle pivotably attached to the upper outer tray.

6. The ice dispenser of claim 1, further comprising an ice container cap fitting over the ice container.

7. The ice dispenser of claim 6, further comprising an ice container cap handle formed in the ice container cap.

8. The ice container of claim 1, further comprising a removable seal disposed between the ice container and the base support ring.

9. The ice container of claim 1, further comprising a cap fitting over an ice cube exit hole of the ice container.

10. The ice container of claim 1, further comprising a turn shaft interconnecting the turn shaft fins with the knob.

11. The ice container of claim 1, further comprising an attached melt spout cap closing the melt spout.

* * * * *